US008573798B2

(12) United States Patent
Reimann et al.

(10) Patent No.: US 8,573,798 B2
(45) Date of Patent: Nov. 5, 2013

(54) SWITCH MODULE FOR A FLASHLIGHT

(75) Inventors: William James Reimann, Boise, ID (US); Yi Bing Li, ZheJiang (CN)

(73) Assignee: Coast Cutlery Co., Portland, OR (US)

( * ) Notice: Subject to any disclaimer, the term of this patent is extended or adjusted under 35 U.S.C. 154(b) by 231 days.

(21) Appl. No.: 13/155,012

(22) Filed: Jun. 7, 2011

(65) Prior Publication Data

US 2012/0314408 A1 Dec. 13, 2012

(51) Int. Cl.
*F21L 4/00* (2006.01)
*H01H 13/76* (2006.01)

(52) U.S. Cl.
USPC ..... 362/208; 200/5; 362/157; 362/295

(58) Field of Classification Search
None
See application file for complete search history.

(56) References Cited

U.S. PATENT DOCUMENTS

| | | | | |
|---|---|---|---|---|
| 5,161,879 | A * | 11/1992 | McDermott | 362/206 |
| 6,210,010 | B1 * | 4/2001 | Pontetti et al. | 362/24 |
| 2005/0122714 | A1 * | 6/2005 | Matthews et al. | 362/206 |
| 2007/0159819 | A1 * | 7/2007 | Bayat et al. | 362/236 |
| 2011/0048909 | A1 * | 3/2011 | Clark et al. | 200/330 |
| 2012/0134142 | A1 * | 5/2012 | Sharrah et al. | 362/157 |

* cited by examiner

*Primary Examiner* — Ashok Patel
(74) *Attorney, Agent, or Firm* — Schwabe, Williamson & Wyatt, P.C.

(57) ABSTRACT

Embodiments herein provide a switch module for a flashlight with a single input contact and multiple output contacts. The switch module may include multiple mechanical actuators, each actuator configured to selectively and communicatively couple one of the output contacts to the input contact. Each actuator may be activated and/or deactivated independently. Accordingly, any combination of the output contacts may be activated and/or deactivated at a given time. The switch module may be incorporated into a flashlight, allowing any of a number of output devices (e.g., light bulbs) to be independently switched on and off from a common power source.

19 Claims, 3 Drawing Sheets

SWITCH MODULE FOR A FLASHLIGHT

TECHNICAL FIELD

Embodiments herein relate to the field of switches.

BACKGROUND

Many devices, such as flashlights, have mechanical switches for selectively connecting an input contact, such as a battery, to an output contact to establish a conductive path and provide power to an output device. Some devices include multiple switches, each one independently coupling a separate input to a separate output. For example, some flashlights have multiple bulbs that may be switched on and off. However, these flashlights require a separate switch to couple each bulb to the battery.

Some switches couple a single input to multiple outputs, however, these switches toggle through a plurality of states, and each output cannot be selected independently.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
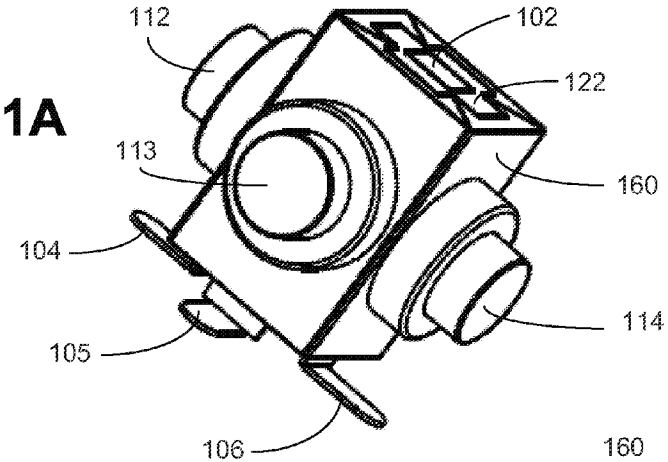
FIGS. 1A-E illustrate perspective views of a switch module in accordance with various embodiments.
Figure 1B:
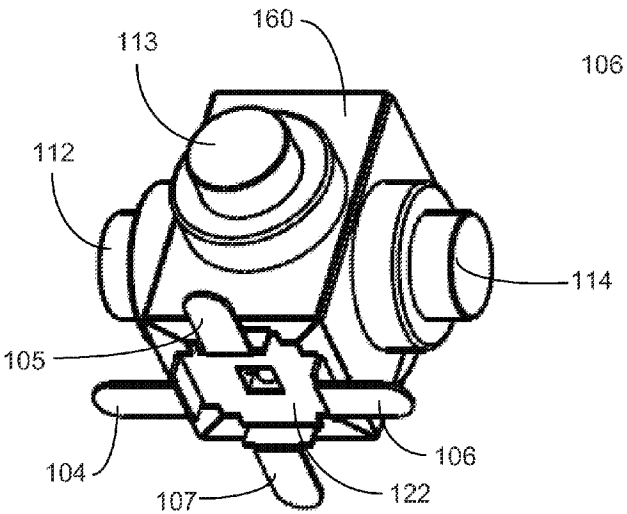
Figure 1C:
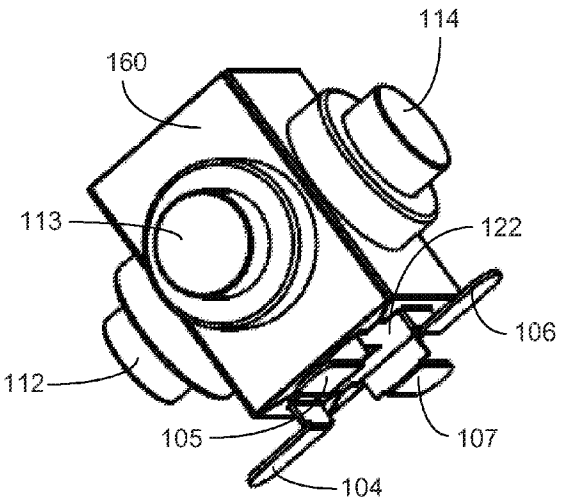
Figure 1E:
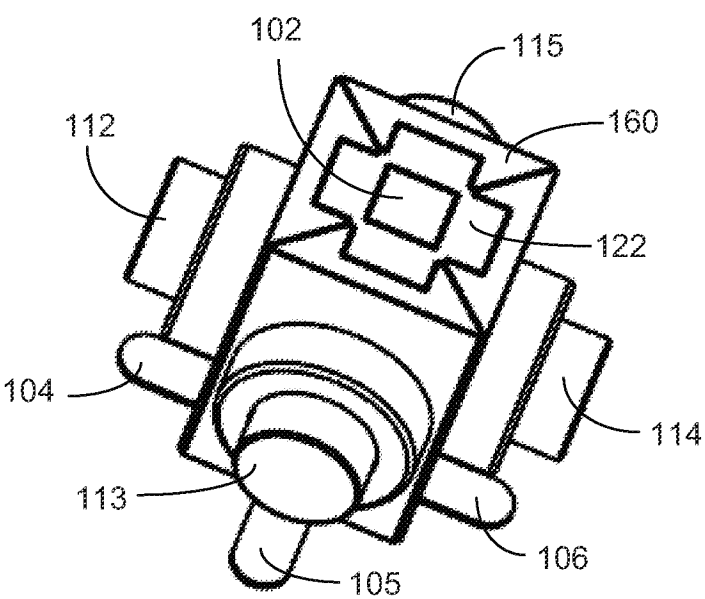
Figure 1D:
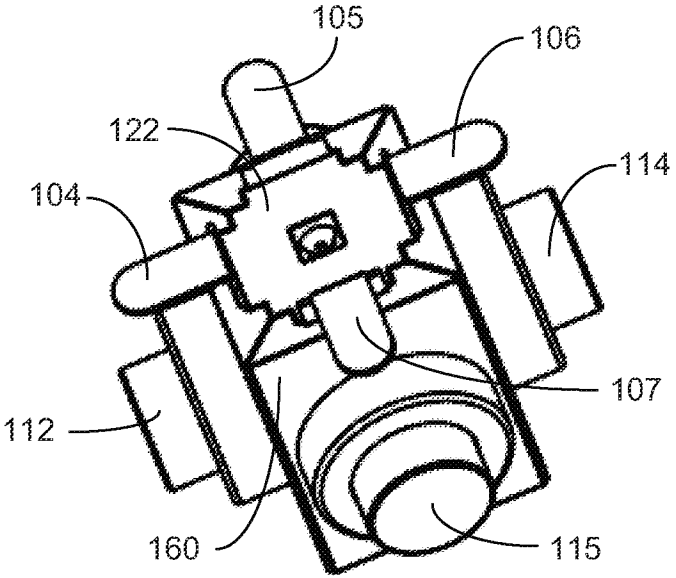

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

In various embodiments, methods, apparatuses, and systems for a single input, multiple output switch module are provided. In exemplary embodiments, a computing device may be endowed with one or more components of the disclosed apparatuses and/or systems and may be employed to perform one or more methods as disclosed herein.

Embodiments herein provide a switch module for a flashlight with a single input contact and multiple output contacts. The switch module may include multiple mechanical actuators, each actuator configured to selectively and communicatively couple one of the output contacts to the input contact. Each actuator may be activated and/or deactivated independently. Accordingly, any combination of the output contacts may be activated and/or deactivated at a given time. The switch module may be incorporated into a flashlight, allowing any of a number of output devices (e.g., light bulbs) to be independently switched on and off from a common power source.

Referring to FIGS. 1A-F, switch module 100 may include an input contact 102 and a plurality of output contacts 104-107. As shown in FIGS. 1A-F, switch module 100 includes four output contacts. However, various embodiments of switch module 100 may include any number of output contacts greater than or equal to two, such as about two to twelve output contacts.

Switch module 100 may further include a plurality of actuators 112-115. Each of the actuators 112-115 may be used to selectively and communicatively couple one of the output contacts 104-107, respectively, to the input contact 102. Each actuator 112-115 may couple the corresponding output contact 104-107 to the input contact 102 when in an activated state, and may uncouple the corresponding output contact 104-107 from the input contact 102 when in a deactivated state. Each actuator 112-115 may be activated and deactivated independently, so that any combination of the output contacts 104-107 may be coupled to the input contact 102 at a given time. Accordingly, switch module 100 provides an efficient mechanism for independent switching of a plurality of outputs with a common input.

Figure 1F:
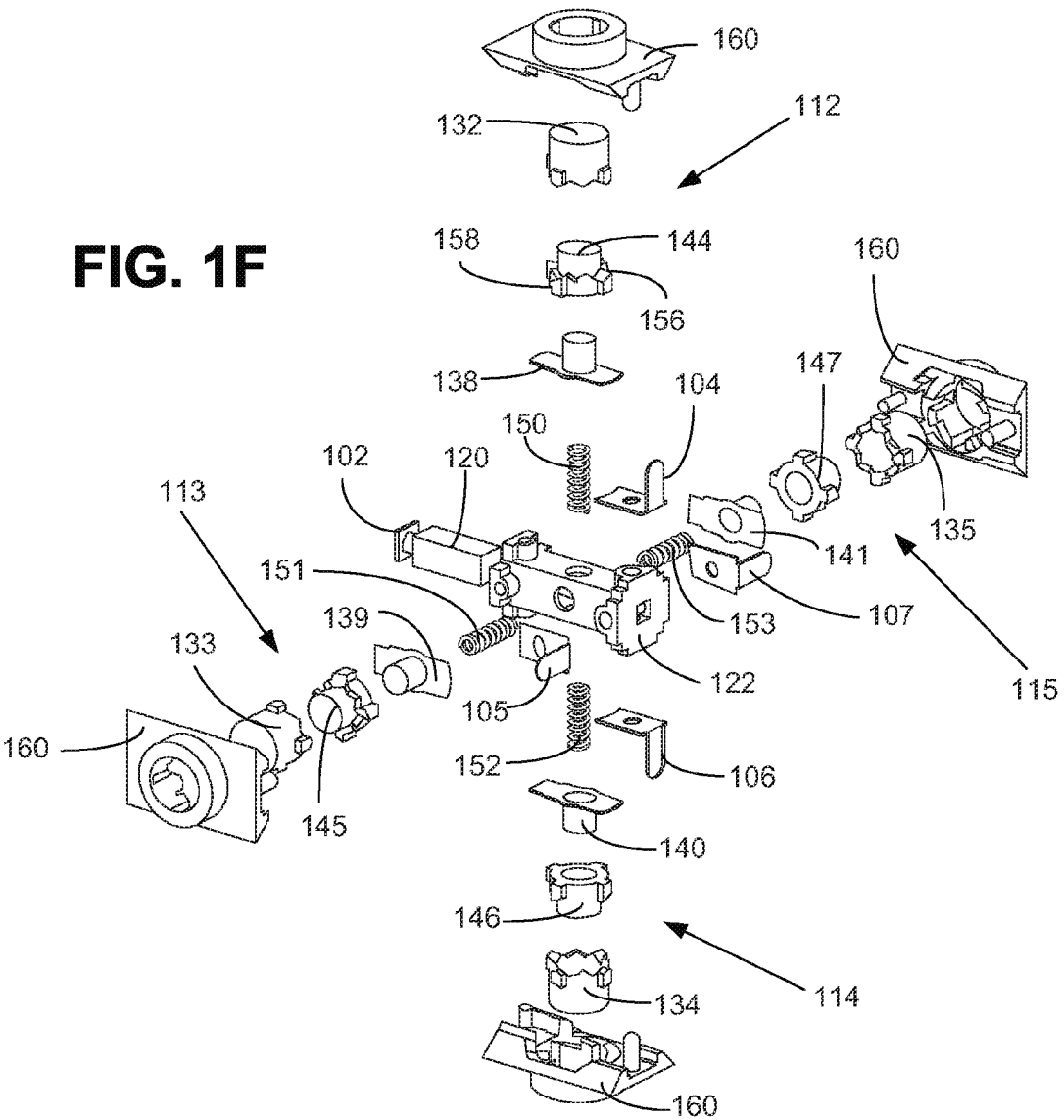
FIG. 1F illustrates an exploded view of the switch module of FIGS. 1A-E.

As best shown in FIG. 1F, input contact 102 may be coupled to a conducting core 120. Input contact 102, output contacts 104-107, and conducting core 120 may be made from a conductive material, such as copper, aluminum, silver, and/or gold. Conducting core 120 may be surrounded by an insulating shell 122 made from an insulating material, such as plastic. Insulating shell 122 may have holes 124-127 to allow actuators 112-115 to communicatively couple to the conducting core 120.

Each actuator 112-115 may include a button 132-135, a conductor 138-141, and a ratcheting member 144-147, respectively. Conductors 138-141 may be communicatively coupled to the conducting core 120, such as through springs 150-153, respectively, disposed through the holes 124-127, respectively, in shell 122. The ratcheting member 144-147 may be coupled between the button 132-135 and conductor 138-141. Each conductor 138-141 may be affixed to the corresponding ratcheting member 144-147 so that the movement of the ratcheting member 144-147 controls the movement of the conductor 138-141.

Each button 132-135 may be depressed by the user to transfer the corresponding actuator 112-115 from the deactivated state to the activated state, and/or from the activated state to the deactivated state. When button 132-135 is depressed, ratcheting member 144-147 may interact with button 132-135 to move the conductor 138-141 into contact with the respective output contact 104-107 during the activated state and move the conductor 138-141 away from contact with the respective output contact 104-107 during the deactivated state. When in the activated state, the conductor 138-141 completes a conductive path between the corresponding output contact 104-107 and the input contact 102. Accordingly, electrical signals, such as power, may be transferred from the input contact 102 to the respective output contact 104-107.

Each successive press of the same button 132-135 may alternate the state of the actuator 112-115 between the activated state and the deactivated state.

In some embodiments, the interaction of the ratcheting member 144-147 with the button 132-135 may be similar to the mechanism found in a retractable pen. Ratcheting member 144-147 and button 132-135 may include sawtooth portions 156 and/or other protrusions that interact with one another. When one of the buttons 132-135 is depressed, the sawtooth portions 156 may cause the corresponding ratcheting member 144-147 to rotate. The ratcheting member 144-147 may stop rotating at one or more detents 158 located circumferentially around the ratcheting member 144-147 and/or button 132-135. The detents 158 may hold the ratcheting member 144-147, and thereby the conductor 138-141, in either the activated state or the deactivated state. The location of the detents 158 may alternate so that each successive press of the actuator changes the state of the conductor.

In some embodiments, the conductor 138-141 may be integrated into the ratcheting member 144-147. For example, the ratcheting member 144-147 may be made from a conductive material and/or include a portion of conductive material to contact the output contact during the activated state.

As shown in FIGS. 1A-F, actuators 112-115 include buttons 132-135. However, any suitable mechanical actuator may be used, such as a button, lever, rotating dial, and/or other mechanical actuator.

Switch module 100 may further include a housing 160 surrounding the other components of switch module 100, but leaving exposed the input contact 102, output contacts 104-107, and buttons 132-135. In some embodiments, housing 160 may be made up of a plurality of portions coupled together.

The actuators 112-115 may be located circumferentially around the housing 160 of the switch module 100. In some embodiments, the housing 160 may generally have a cross-sectional shape resembling a regular polygon (e.g., equilateral triangle, square, regular pentagon, regular hexagon, etc.). An actuator may be disposed on each face of the housing 160. In other embodiments, multiple actuators may be located on one or more faces of the housing 160. Alternatively, the housing 160 may be generally cylindrical.

In some embodiments, the switch module 100 may be incorporated into a flashlight. The flashlight may further include one or more power sources, such as batteries, one or more output devices, such as bulbs, a focusing lens, and/or a housing. The switch module 100 may be disposed within the housing of the flashlight, between the power source and the output devices. The input contact 102 of the switch module 100 may be communicatively coupled to the power source. Each output contact 104-107 may be coupled to a different set of one or more of the output devices. The flashlight housing may have any suitable shape. For example, the flashlight housing may be generally cylindrical or may have a cross section that resembles a regular polygon. In some embodiments, the housing of the flashlight may have a similar cross-sectional shape to the housing 160 of the switch module. The buttons 132-135 of the switch module 100 may extend out from the flashlight housing to be accessible by the user.

In some embodiments, each contact 104-107 may be coupled to output devices having different properties, such as different colors, light intensities, light outputs, bulb sizes, bulb types (e.g., light emitting diode (LED), incandescent), flashing characteristics, focus properties, and/or reflection properties. For example, output contact 104 may be coupled to a white LED, output contact 105 may be coupled to a red LED, output contact 106 may be coupled to a blue LED, and output contact 107 may be coupled to a green LED. It will be apparent that a number different of combinations of output devices are possible. In some embodiments, different output contacts may be coupled to different bulbs of the same type, so that activating additional actuators provides additional light.

Accordingly, switch module 100 may allow any of the plurality of output devices in the flashlight to be turned on and/or off independently. Any combination of the output devices may be on and/or off at a given time, as controlled by the user.

It will be apparent that many other uses for the switch module 100 are possible. The input contact 102 may be coupled to any suitable input electrical signal, such as a power signal and/or communication signal. The output contacts 104-107 may be coupled to any suitable output devices configured to receive the input signal.

Some embodiments of switch module 100 may include a plurality of input contacts to be used with multiple power sources, e.g., multiple batteries. The input contacts may all be coupled to the conducting core 120. Alternatively, the output contacts 104-107 may be separately coupled to one or more of the plurality of input contacts.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A switch module for a flashlight comprising:

an input contact;

a plurality of output contacts; and a plurality of mechanical actuators, each actuator configured to selectively and communicatively couple one of the plurality of output contacts to the input contact when the actuator is activated;

wherein each actuator may be independently activated and/or deactivated in order to activate the flashlight in one of a plurality of modes.

2. The switch module of claim 1, further comprising:

a conductive core communicatively coupled to the input contact;

an insulating shell located circumferentially around the conductive core and having a plurality of holes, the output contacts coupled to the insulating shell and the actuators communicatively coupled to the conductive core through the holes in the insulating shell;

wherein each actuator includes a conductive portion that contacts one of the output contacts when the actuator is activated to connect a conductive path from the input contact to the output contact, and the conductive portion does not contact the output contact when the actuator is deactivated.

3. The switch module of claim 2 wherein each actuator includes a button that interacts with a ratcheting member to activate and/or deactivate the actuator when the button is depressed.

4. The switch module of claim 3 wherein each actuator alternates between being activated and deactivated with successive presses of the corresponding button.

5. The switch module of claim 2, wherein the actuators are located circumferentially around a housing of the switch module.

6. The switch module of claim 5 wherein the housing has a cross section that resembles a regular polygon, each side of the polygon having an actuator coupled thereon.

7. The switch module of claim 1 wherein the plurality of output contacts consists of about two to about twelve output contacts.

8. The switch module of claim 1 wherein the plurality of output contacts consists of four output contacts.

9. The switch module of claim 1, further comprising:

a conductive core communicatively coupled with the input contact;

wherein the plurality of actuators are arranged around the conductive core, and each actuator includes a conductive portion configured to selectively form a conductive path between the input contact and the output contact, via the conductive core, when the actuator is activated.

10. The switch module of claim 9, wherein the conductive portion of the actuator is configured to selectively contact the output contact when the conductive portion is activated, and does not contact the output contact when the actuator is deactivated.

11. A flashlight comprising:

a power source;

a plurality of output devices; and a switch module comprising:

an input contact coupled to the power source;

a plurality of output contacts, each output contact coupled to one or more of the output devices; and a plurality of mechanical actuators, each actuator configured to selectively communicatively couple one of the plurality of output contacts to the input contact when activated, thereby transferring power from the power source to the respective one or more output devices of the flashlight;

wherein each actuator may be independently activated and/or deactivated.

12. The flashlight of claim 11, wherein the switch module further comprises:

a conductive core communicatively coupled to the input contact;

an insulating shell located circumferentially around the conductive core and having a plurality of holes, the output contacts coupled to the insulating shell and the actuators communicatively coupled to the conductive core through the holes in the insulating shell;

wherein each actuator includes a conductive portion that contacts one of the output contacts when the actuator is activated to connect a conductive path from the input contact to the output contact, and the conductive portion does not contact the output contact when the actuator is deactivated.

13. The flashlight of claim 12 wherein each actuator includes a button that interacts with a ratcheting member to activate and/or deactivate the actuator when the button is depressed.

14. The flashlight of claim 12 wherein the actuators are located circumferentially around a housing of the switch module.

15. The flashlight of claim 12 wherein the housing has a cross section that resembles a regular polygon, each side of the polygon having an actuator coupled thereon.

16. The flashlight of claim 11 wherein the plurality of output contacts consists of about two to about twelve output contacts.

17. The flashlight of claim 11 wherein the plurality of output contacts consists of four output contacts.

18. The flashlight of claim 11, wherein two or more of the output devices have different operating properties from one another.

19. The flashlight of claim 18, wherein the different operating properties are selected from a list comprising: color, light intensity, light output, bulb size, bulb type, focus properties, and reflection properties.

* * * * *